US005462245A

United States Patent [19]

Durchschlag

[11] Patent Number: 5,462,245

[45] Date of Patent: Oct. 31, 1995

[54] APPARATUS FOR LOCKING MOVEABLE SWITCH PARTS

[75] Inventor: Gerald Durchschlag, Zeltweg, Austria

[73] Assignee: VAE Eisenbahnststeme Aktiengesellschaft, Vienna, Austria

[21] Appl. No.: 168,256

[22] Filed: Dec. 17, 1993

[30] Foreign Application Priority Data

Dec. 17, 1992 [AT] Austria ..... 2507/92

[51] Int. Cl.[6] ..... B61L 11/00

[52] U.S. Cl. ..... 246/448

[58] Field of Search ..... 246/415 R, 443, 246/448–452; 188/82.84, 67

[56] References Cited

U.S. PATENT DOCUMENTS

| | | | |
|---|---|---|---|
| 1,446,743 | 2/1923 | Fisher | 246/448 |
| 3,269,199 | 8/1966 | Deehan et al. | 188/82.84 |
| 3,937,295 | 2/1976 | Wright | 180/103 BF |
| 4,586,425 | 5/1986 | Redman et al. | 188/67 |
| 4,991,515 | 2/1991 | Evenzon et al. | 104/88 |

FOREIGN PATENT DOCUMENTS

| | | |
|---|---|---|
| 64249 | 11/1982 | European Pat. Off. . |
| 125871 | 11/1984 | European Pat. Off. . |
| 289978 | 11/1988 | European Pat. Off. . |
| 317927 | 5/1989 | European Pat. Off. . |
| 467865 | 1/1992 | European Pat. Off. . |
| 1777214 | 7/1971 | Germany . |
| 2521970 | 11/1976 | Germany . |
| 125282 | 4/1977 | Germany . |

*Primary Examiner*—Mark T. Le
*Attorney, Agent, or Firm*—Cushman, Darby & Cushman

[57] ABSTRACT

In an apparatus that is used to lock the end positions of moveable switch-point parts, in particular a switch-point lock, in which two parts (2, 3) that are moveable relative to each other can be moved in at least one direction of movement in a position in which they are positively locked, the parts that can be moved relative to each other are formed by a tube (2) and a bolt (3) that is axially guided within the tube (2), additional separate lock elements (4) such as, for example, balls or rollers that can be displaced in a radial direction, being used (FIG. 1).

11 Claims, 7 Drawing Sheets

17
15
32
2
1
3
9
10
20
33
4
16
18
12
34

35
36
2
1
3
4
37

17
15
41
42
3
39
2
1
33
2
4
3
42
40
41
16
18
40
4
44
43

APPARATUS FOR LOCKING MOVEABLE SWITCH PARTS

BACKGROUND OF THE INVENTION

1. Field of the Invention

The present invention relates to an apparatus for locking the end positions of the moveable elements of switch-point machines, in particular a switch-point lock, in which two parts that can move relative to each other are moveable in at least one direction of movement in a position in which they are positively locked.

2. Brief Description of the Prior Art

The so-called clamp-tip lock is known, for example, for locking moveable switch-point parts, in particular in the form in which they are configured as a switch lock. When the lock is configured in this way, there are two parts that are moveable relative to each other, one part being guided in a recess within the other and, in order to take up the two operating positions, this has to be pivoted relative to the other part in the plane of movement. In another configuration, pivoting out of the plane of movement is necessary. All in all, all these known switch-point locks are so configured that a more or less complex off-axis movement is required, and such that the parts that effect the lock are exposed and are thus vulnerable to dirt. The risk of such accumulations of dirt can prevent reliable locking.

SUMMARY OF THE INVENTION

It is the task of the present invention to create an apparatus of the type described in the introduction hereto, which permits a completely enclosed construction and is thus protected from the ingress of dirt and which, in addition, avoids the off-center loads from the locking elements that can affect service life. In order to solve this problem, the configuration according to the present invention is essentially such that the parts that can move relative to each other are formed from a tube and a bolt that is guided in the tube, and such that separate locking elements, for example, balls or rollers that can be displaced in a radial direction, are used. Because of the fact that the parts that can move relative to each other are moved relative to each other in an exclusively axial direction, since one of the two parts is guided by a structural element that is guided in the other part, the danger of off-center and eccentric forces is avoided, and because of the fact that one of the structural elements is a tube and encloses the other structural element, a completely enclosed configuration results and this is protected against the ingress of dirt. In a configuration of this kind, the locking itself is effected by separate locking elements that can be formed from balls or rollers. In the event that rollers are used, these must naturally be of a smaller axial length and be so supported as to rotate about axes that intersect with the longitudinal axis of the bolt or of the tube, so as not to prevent the displacement of the two structural elements within each other. When this is done, the locking elements can be of such dimensions during displacement each of them run between the inside profile of the outermost structural element and the outer profile of the innermost structural element, locking being effected by radial displacement of the balls or rollers.

When this is done, the configuration is achieved in a particularly simple manner such that the parts that can move relative to each other are guided in a fixed outer tube which, on its inside surface, has at least one axial area which is of an enlarged inside diameter. An outer tube of this kind encloses, in particular, a locking element that can be displaced outward in a radial direction, and for this reason can prevent the ingress of dirt or dust at this point, as well. Furthermore, as an enclosed structural element that is additionally protected, an outer tube of this kind offers the possibility, if so desired, of incorporating an actuator drive, an in a preferred embodiment, which can then be arranged within the fixed outer tube.

In a particularly simple manner, locking is effected by the locking elements that can be displaced in a radial direction such that the part that is formed from a tube and which can be displaced along its axis incorporates radial openings to accommodate the locking elements.

Limiting of the relative displacement of the innermost bolt-like structural element, which is guided axially within the tube relative to the outermost tubular structural element that can be displaced in the axial direction can be achieved very simply in that the tubular part that can be moved along its axis incorporates at least one rim that projects inwards, and works in conjunction with a stop on the bolt-like part that can be moved along its axis. An inwardly projecting rim of this kind also entails the advantage that a spring can be arranged between the inwardly projecting rim and a stop on the bolt-like structural element that works in conjunction with this rim. It is advantageous if a spring of this kind can be configured as a coil spring, and a configuration of this kind can also serve as an aide to changing over or setting [the points], for during the setting procedure, if an apparatus according to the present invention is associated with each moveable rail, initially both springs will be compressed, and this will result in a dead point, and at each of the end positions one spring will once again be expanded. Given a suitable configuration of the spring characteristics, the setting movement will be assisted, proceeding from the particular dead point position which will result in the added advantage that a switch point that is actuated in this way or which is equipped with such a lock element can be run through against the force of a spring.

In a particularly advantageous manner, the configuration is such that the bolt-like displaceable part is of a stepped-down diameter along part of its length. In the position in which they are displaced radially inwards, the locking elements can roll in the longitudinal direction of the bolt through a section of the length of the bolt-like structural element of this kind so that in each instance an advance or after-run of the setting movement is made possible and in which a locked position is not yet reached. Only after running onto the larger diameter of the bolt by way of a conical surface can the locking elements then move out of the way if they can pass through the openings in the tube-like outermost structural element that can move in the axial direction and, for example, enter an appropriate annular groove or recess in the outer tube. Locking will only be made possible in this second position.

In order to permit non-contact rolling of the locking elements on the particular outer surfaces, the configuration can be such that the difference in diameter between the smaller diameter of the bolt-like part and the inside circumference of the fixed outer tube, like the difference in diameter between the greater diameter of the bolt-like part and the area of the stationary tube that is of greater inside diameter is greater than the diameter of the locking elements.

In order to provide appropriate support and guidance of the locking elements and to reduce wear on the locking elements it is preferred that the configuration be such that the wall thickness of the displaceable tube-like part be greater than the half diameter of the locking elements formed from balls or rollers.

As has been discussed heretofore, in the configuration according to the present invention, the locking is effected in that the locking elements can pass through openings in the tubular structural element that can be moved in an axial direction, when locking is achieved if the balls that are displaced outwards in this way, in an axial direction, can enter an annular groove or recess on the inside circumference of the stationary outer tube. It is advantageous if the configuration be such that the stationary outer tube incorporates at least two annular grooves that are arranged on the inside circumference and spaced apart from each other.

Depending on acceptability and the requirements of railroad legislation, the lock according to the present invention can also be used directly as an actuator for setting a switch point, when it is advantageous if the configuration be such that one of the parts that can be moved axially relative to each other, in particular the bolt-like part, be connected to an actuator drive, as has been discussed heretofore, the fixed outer tube being particularly suitable for the arrangement of such an actuator drive.

BRIEF DESCRIPTION OF THE DRAWINGS

The present invention will be described in greater detail below on the basis of embodiments that are shown diagrammatically in the drawings appended hereto. These drawings show the following.

DESCRIPTION OF THE PREFERRED EMBODIMENTS

Figure 1:
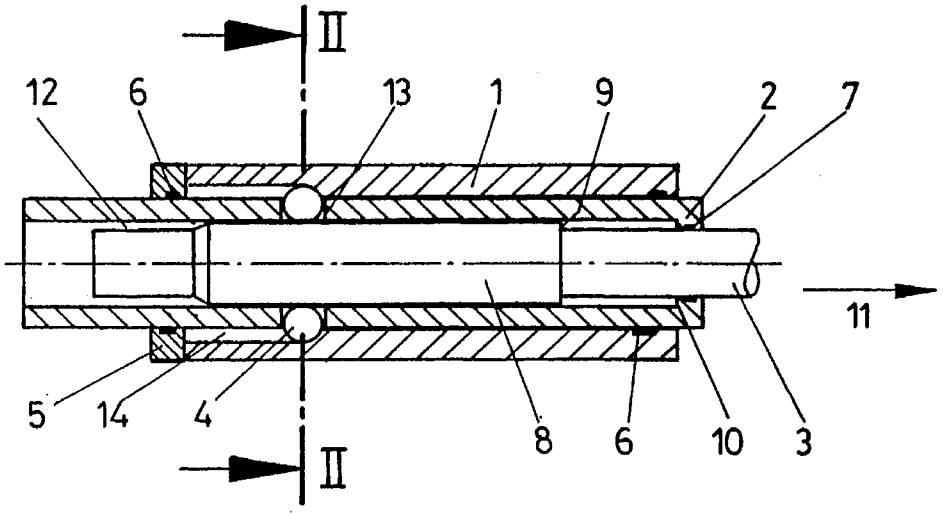
FIG. 1 is a cross-section through a first embodiment of an apparatus according to the present invention for locking the end positions of moveable switch-point parts, balls being used as the locking elements in this.
Figure 2:
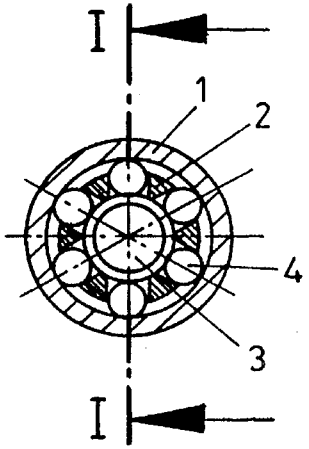
FIG. 2 is a cross-section on the line II—II in FIG. 1, FIG. 1 being a cross-section on the line I—I in FIG. 2.

FIGS. 1 and 2 are cross-sections through an apparatus for locking the end positions of the moveable parts of switch points; the parts that can move relative to each other in the form of a tube 2 and a bolt 3 that is guided axially within the tube 2 being arranged within an outer tube 1. The outer tube 1 that forms a housing is fixed in position, and the parts that can move relative to each other, i.e., the tube 2 and the bolt 3, are connected with a moveable section of rail and/or to an actuator, as can be seen more clearly from the subsequent drawings. The tube 2 and the bolt 3 work in conjunction with each other through lock elements 4 which, in the embodiment shown in FIGS. 1 and 2, are in the form of balls. The outer tube housing 1 is closed off by a cover 5, seals being shown between the tubular moveable part 2 and the outer tube 1 or the cover 5, at 6. There are additional seals 7 between the bolt 3 and the tube 2.

The bolt 3 incorporates a section 8, the outside diameter of which corresponds to the inside diameter of the tube 2. Adjacent to the section 8, the bolt 3 has a stop 9 that defines an area of smaller diameter, and this stop 9 works in conjunction with a rim 10 of the tube 2 when the bolt 3 is displaced by a pre-set amount of travel. After displacement of the bolt 3 in the direction indicated by the arrow 11, when the stop 9 works in conjunction with the rim 10, the lock elements 4 move into another section 12 of the bolt that is of reduced diameter, thereby permitting further displacement of the bolt 3 and of the tube 2 in the direction indicated by the arrow 11. When this is done, the lock elements 4 in the form of balls extend through radial openings 13 within the tube 2 and in the stepped-down section areas 14, which can be formed, for example, as longitudinal grooves, that are guided in the outer tube 1. Because of the interaction of the stop 9 with the rim 10, and the subsequently possible displacement both of the bolt 3 and of the tube 2, there is the possibility for an advance or after-run during a change-over movement of a moveable switch-point part, as can be seen more clearly in the following figures. The wall thickness of the tube 2 is greater than the half diameter of the balls 4.

Figure 3:
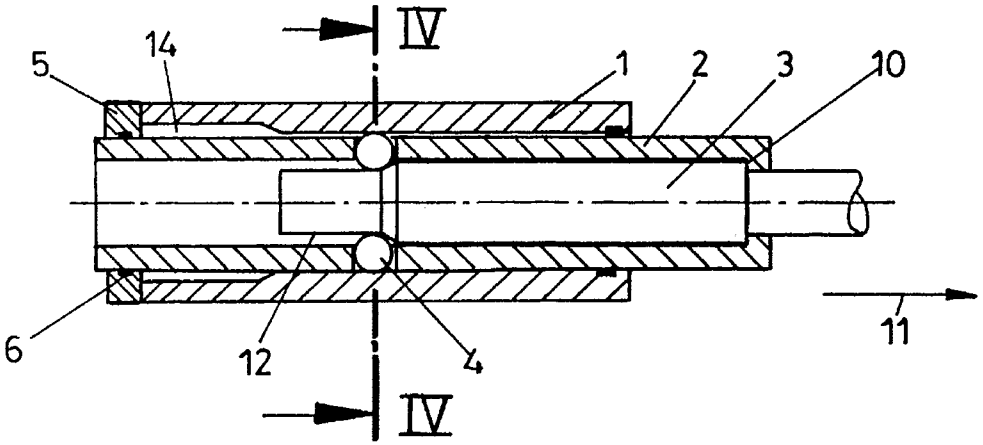
FIG. 3 is a cross-section through a modified embodiment of an apparatus according to the present invention used to lock the end positions of moveable switch-point parts, rollers being used as the locking elements, this drawing being analogous to FIG. 1.
Figure 4:
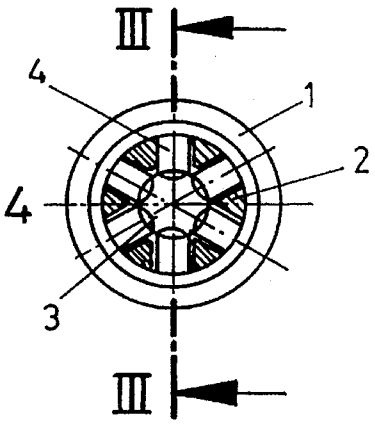
FIG. 4 is a cross-section on the line IV—IV in FIG. 3, FIG. 3 being a cross-section on the line III—III in FIG. 4.

In FIGS. 3 and 4 the apparatus is used to lock the end positions of moveable switch-point parts in a position that has been displaced in the direction indicated by the arrow 11 as in FIG. 1, and it can be clearly seen that the bolt 3 has also caused displacement of the tube 2 in the direction indicated by the arrow 11 by interaction of the stop 9 with the rim 10 of the tube 2. Because of the fact that after a first displacement of the bolt 3 the lock elements 4 have moved into the stepped-down section 12 of the bolt, displacement of the tube through the position shown in FIG. 1 is possible. In the embodiment shown in FIGS. 3 and 4, the lock elements are in the form of rollers 4.

Figure 5:
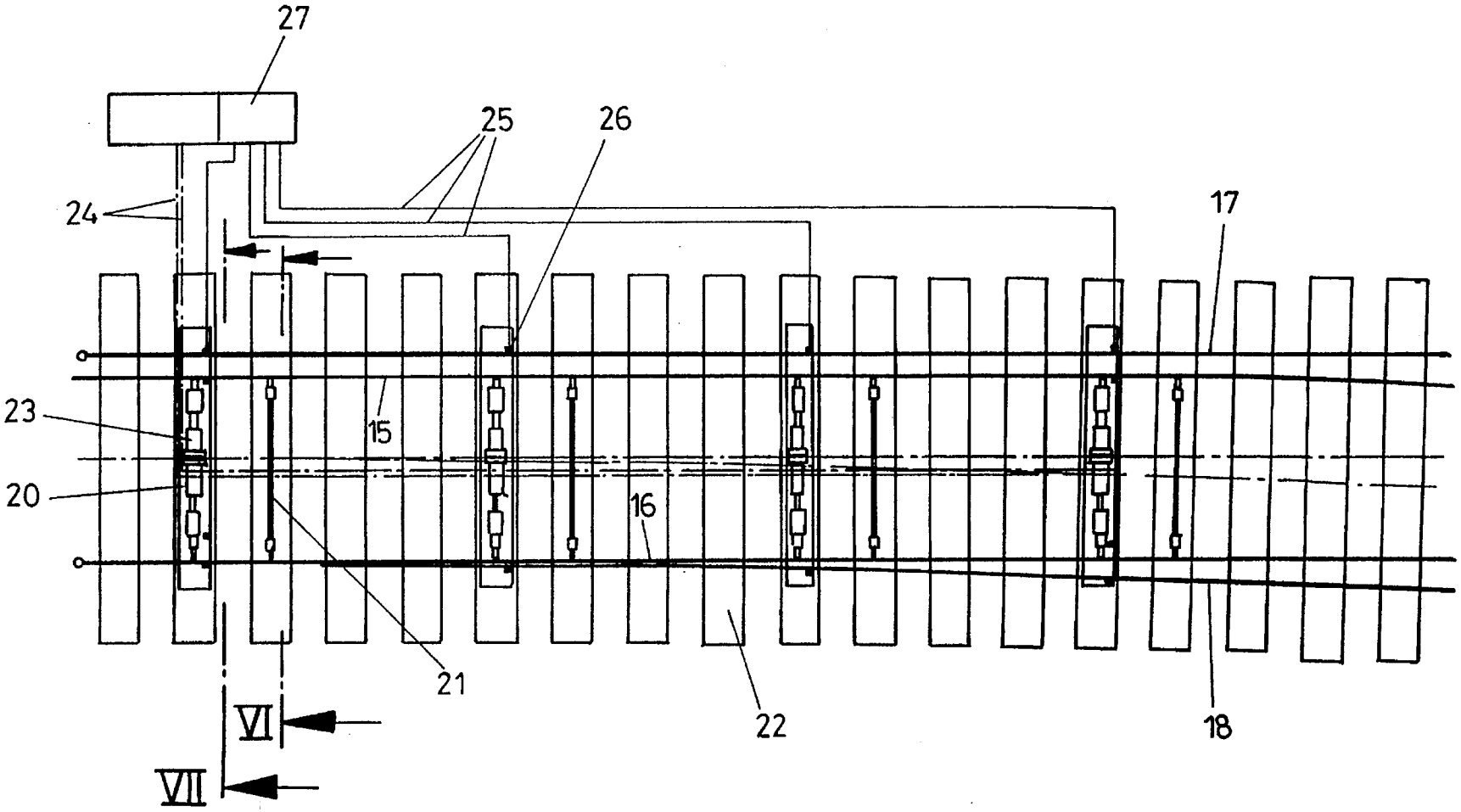
FIG. 5 is a diagrammatic plan view of a switch-point, the apparatus according to the present invention being used to lock the end positions of moveable switch-point parts.

The depth of the stepped-down sections 12 and 14 correspond essentially to the diameter of the lock elements 4 reduced by the wall thickness of the inner tube 2. FIG. 5 is a diagrammatic representation of a switch point, the switching of the tongue blades 15, 16 into positions that each lie on the stock rails 17, 18 being effected by a plurality of locks that bear the common reference number 20, which each incorporate the apparatuses shown in greater detail in FIGS. 1 to 4, as is shown in greater detail in the following figures. In addition, between the tongue blades 15, 16, there are also connecting rods 21. The stock rails 17 and 18, as well as the tongue blades 15, 16, rest in the manner generally known on ties 22 and are supported by slide plates or base plates. Actuators 23 that are located between these are used for the switch motion of the tongue blades 15, 16, and these actuators 23 operate in conjunction with the apparatuses shown in FIGS. 1 to 4. In this connection, control lines 24 for the actuator drives are shown diagrammatically in FIG. 5. In addition, evaluator lines 25 are also shown, and these work, for example, in conjunction with end switches 26 and provide an indication that the tongue blade is in position. A common evaluating and regulating and control unit 27 is also shown.

Figure 6:
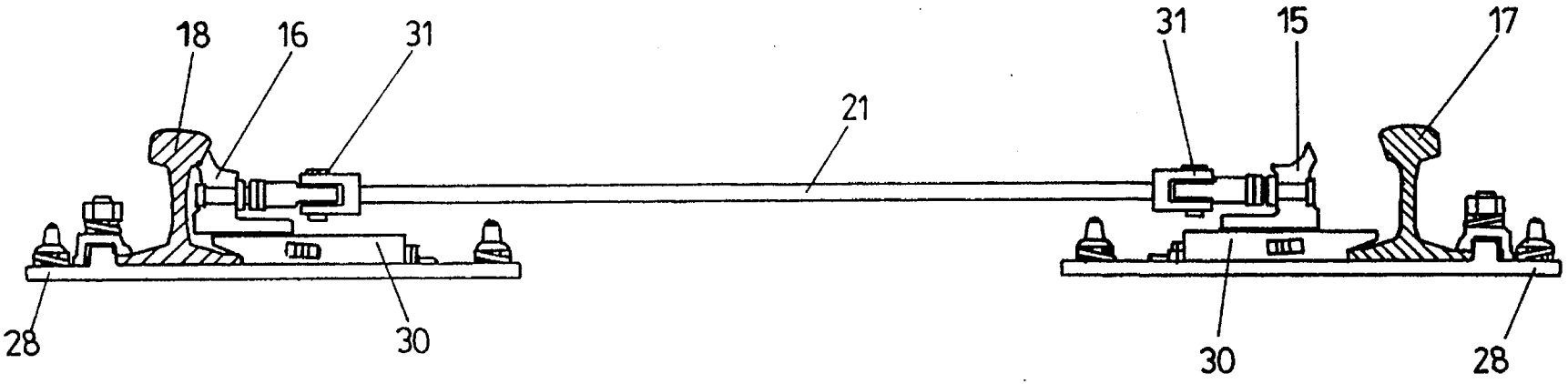
FIG. 6 is a cross-section on the line VI—VI in FIG. 5.
Figure 7:
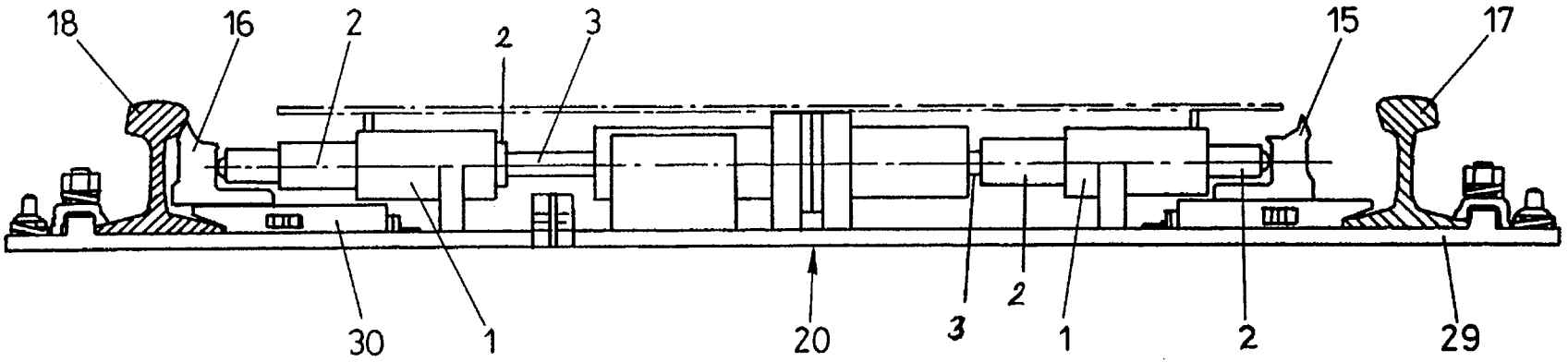
FIG. 7 is a cross-section on the line VII—VII in FIG. 5, the configuration shown in FIGS. 6 and 7 showing a push-type lock for switch points with connecting rods between the moveable tongue blades.

FIGS. 6 and 7 show the attachment of the stock rails 17 and 18 on ribbed plates or supporting plates. In addition, FIG. 6 also shows the arrangement of the connecting rod 21 between the tongue blades 15, 16, which ensures the desired spacing between the tongue blades 15 and 16. The tongue blades are arranged in the known manner so as to be displaceable on a slide chair 30.

FIG. 7 shows that each tongue blade 15 or 16 has an associated apparatus for locking the end positions of the moveable switch-point parts; the tube 2 that is guided in the fixed outer tube 1 of an apparatus of this kind, and which can be displaceable, is pressed against the inner side of the rail foot of each associated tongue blade 15 and 16, whereas the bolt 3 that is guided so as to slide within the tube 2 works in conjunction with an actuator 20 that is shown diagrammatically and is located between the tongue blades. The appropriate action on the bolt-like moveable part 3 in the apparatuses used to lock the end positions of moveable switch-point parts switches the tongue blades.

The embodiment of a push-type lock that is shown in FIGS. 6 and 7 and which incorporates a connecting rod 21 is particularly useful for switch points in high-speed applications, when no run-through of the points is desired and when any flutter in the tongue blades is to be avoided by bilateral locking. All in all, only a push-type arrangement of the apparatus to lock the end positions results on the tongue blades 15 and 16 so that no length-equalizing connecting pieces are required. Furthermore, bilateral locking results with each unilateral lock by the additional use of the connecting rods that are coupled to the tongue blades 15 and 16 through the links 31.

Figures 8A, 8B, 8C, 8D:
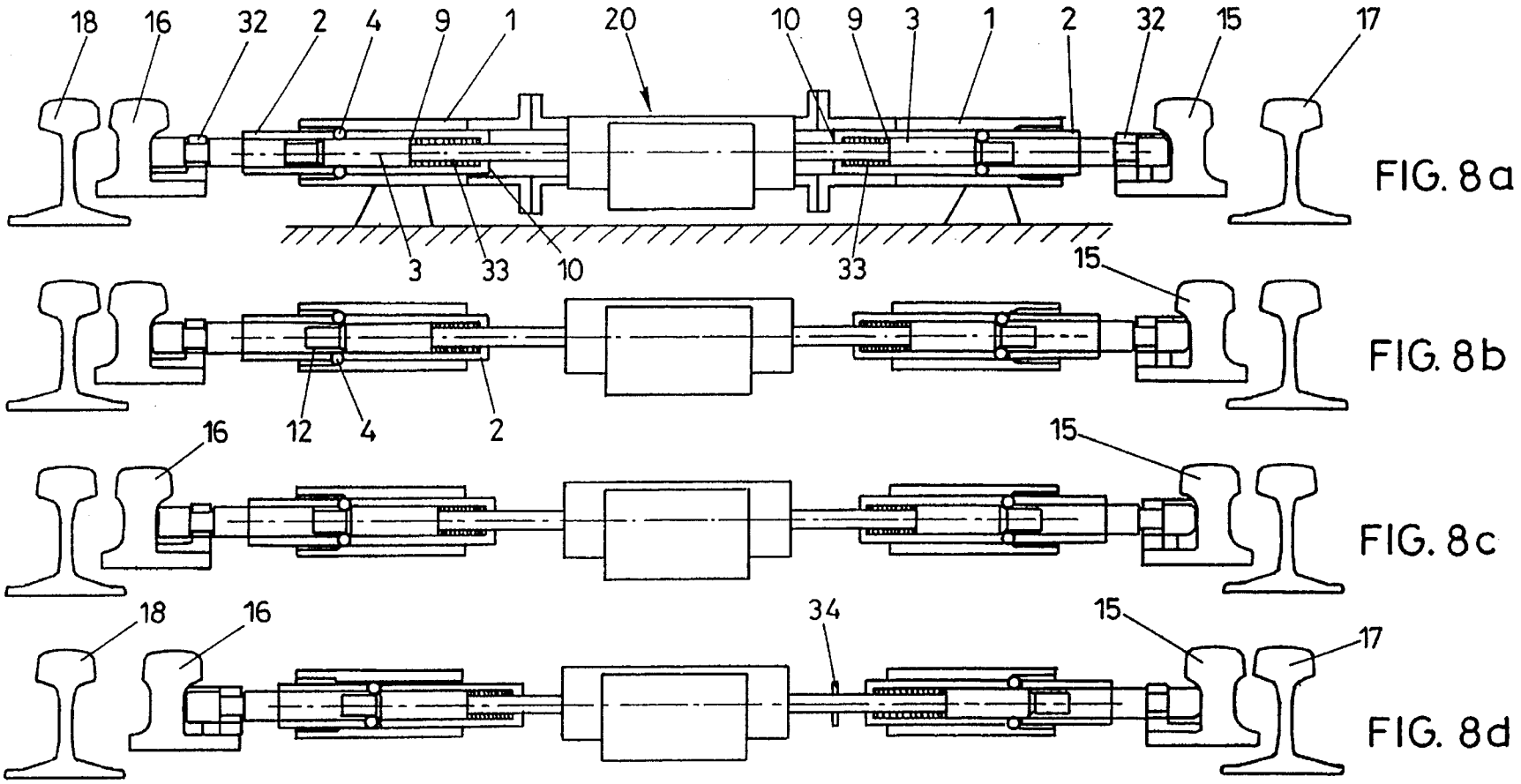
FIGS. 8*a* and 8*d* various positions of a pull-type lock that uses apparatuses according to the present invention to lock the end positions of the moveable switch-point parts, this drawing being in partial cross-section.

FIGS. 8*a* to 8*d* show a pull-type lock that uses apparatuses for locking the end positions of moveable switch-point parts, this being shown in partial cross-section, with the rails in different positions. In this embodiment, the tongue blades 15 or 16 are connected through the connector pieces 32 directly to the tubular moveable part 2 of each associated apparatus for locking the end positions of the tongue blades. The moveable bolt-like parts 3 are once again connected to an actuator 20 that is located between the tongue rails. In addition, this embodiment makes provision such that compression springs 33 are arranged between the stop 9 of the bolt-like part 3 and the associated rim 10 of the tubular part, and these are either compressed or expanded according to the particular position that has been occupied. FIGS. 8*a* to 8*d* show the sequence of a switching movement of the tongue rails 15 or 16. When the bolt-like moveable parts 3 that are connected to each other are acted upon by the actuator drive 20, starting from the position shown in FIG. 8*a*, the compression springs 33 that are shown on the left-hand side of the drawing are acted upon by the actuator drive 20, and simultaneously the displacement movement of the tongue rail 15 that is shown in the right-hand side of the drawing begins, while whereas the tongue rail 16 remains in its original position. Only in the position that is shown in FIG. 8*b* is the displacement movement of the tubular part 2 permitted once the lock elements 4 drop into the stepped-down area 12 of the bolt-like part 3 so that, starting from this position, together with a displacement of the tongue rail 15, the tongue rail 16 also moves, as is shown in FIG. 8*c*.

FIG. 8*d* shows the second end position in which the tongue rail 16 is spaced apart from the stock rail 18, whereas the tongue rail 15 is in its position next to the stock rail 17. A stop 34 is shown and this limits the displacement movement of the bolt-like parts 3. All in all, it is shown that because of the coupling of two apparatuses to lock the end positions of moveable switch-point parts, there is in each instance an advance or after-run during the switch movement, when the springs 33 assisting this.

The embodiment in shown FIGS. 8*a* to 8*d* is designated for trailable switch-points since the open tongues are run over first and the lock is not arrested on this side.

Figures 9A, 9B:
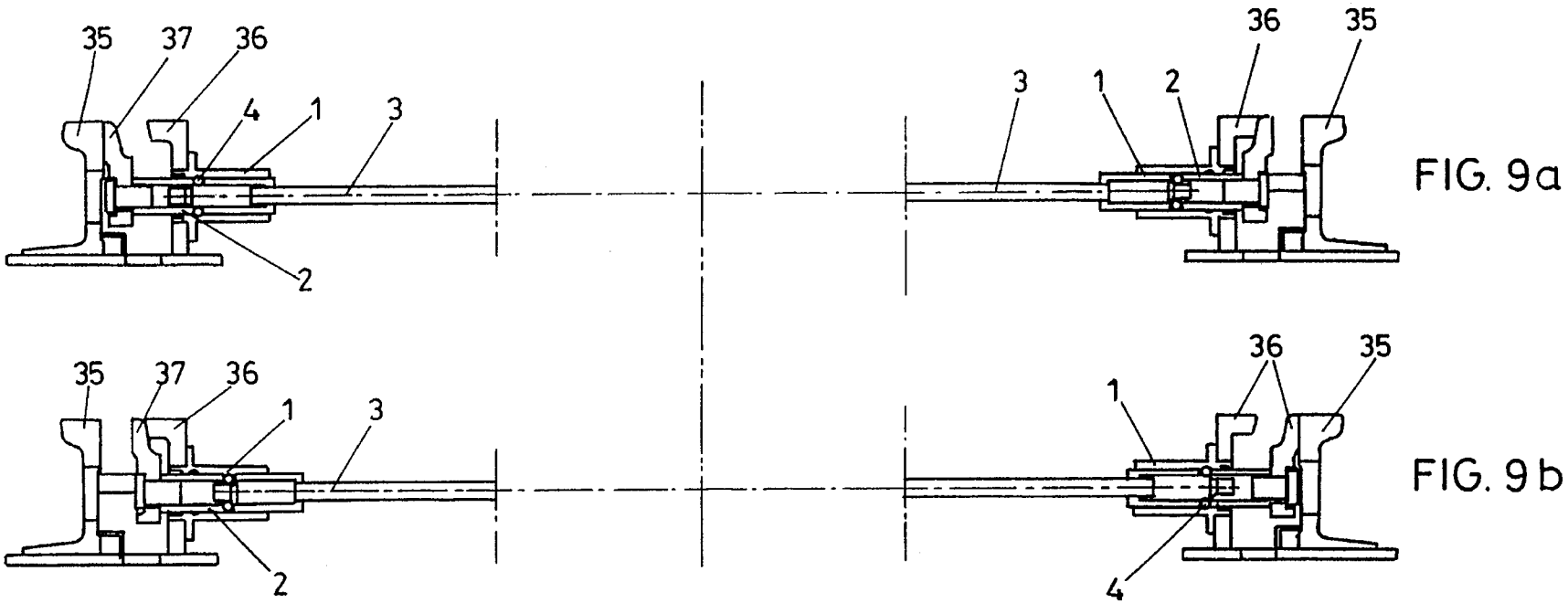
FIGS. 9*a* and 9*b* are cross-sections through a pull-type lock using apparatuses according to the present invention for grooved rails.

FIGS. 9*a* and 9*b* show the end positions of a similar push-type lock for a grooved rail. The rigid elements of the grooved rails are numbered 35 or 36, whereas the moveable rails or the moveable switch-point parts are numbered 37. The tube-like part 2 that is connected to the moveable rails 37 passes through the inside fixed rail sections 36. The fixed outer tube 1 is also arranged on the inside section 36 of the grooved rail. In this embodiment, the drive is configured similarly to that of the embodiment shown in FIGS. 8*a* to 8*d*, although assistance provided by the compression springs has been dispensed with in this embodiment.

Figures 10, 11A, 11B, 11C, 11D:
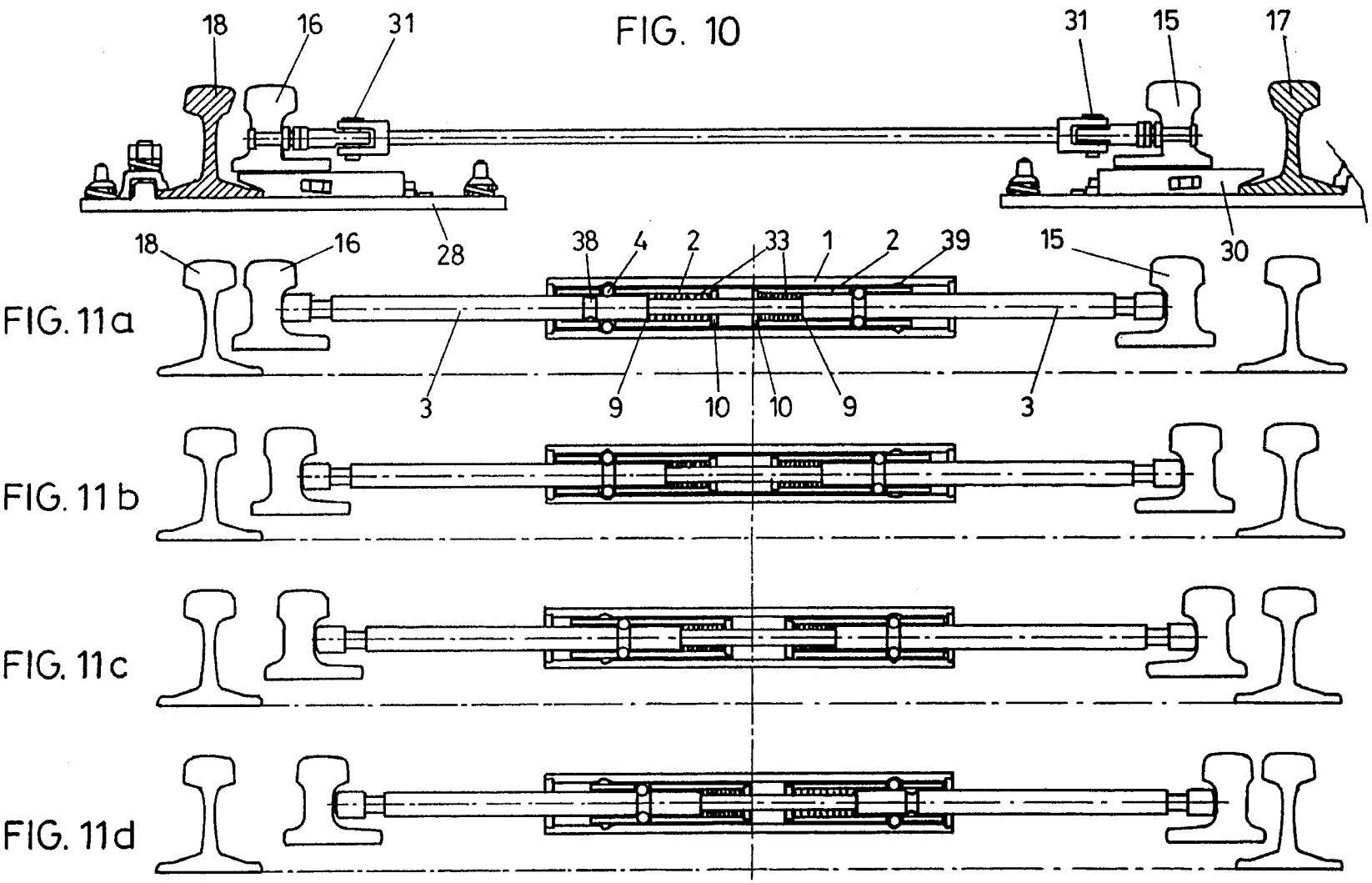
FIG. 10 is a view analogous to that in FIG. 6, showing the use of a connecting rod in a switching aide for moveable tongue blades, when the apparatus according to the present invention is used to lock the end positions of the moveable switch-point parts.
FIGS. 11*a* to 11*d* in a drawing analogous to FIGS. 8*a* to 8*d*, a push-type switching aide using the apparatus according to the present invention to lock the end positions of the moveable switch-point parts.
Figures 12A, 12B, 12C, 12D:
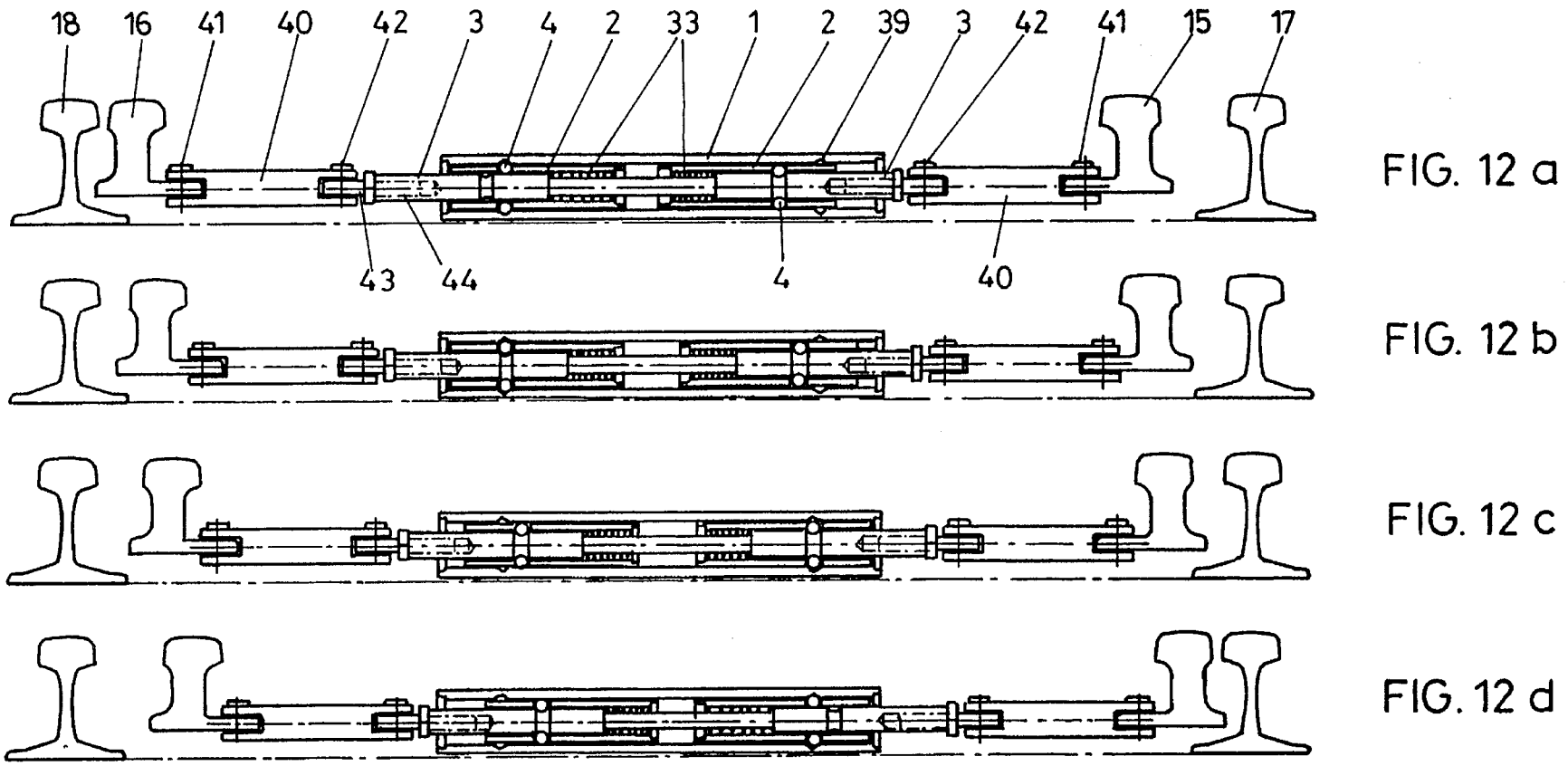
FIGS. 12*a* to 12*d*in a drawing analogous to FIGS. 11*a* to 11*d*, a push and pull-type switching aide, using the apparatus according to the present invention to lock the end positions of the moveable switch-point parts.

In FIG. 10, analogously to the drawing shown in FIG. 6, there is a connecting rod 21 between the tongue blades 15 and 16.

Forming part of this, in FIG. 11*a* to 11*d*, there is a push-type setting aid; in this embodiment, in each instance the bolt-like moveable parts 3 lie against the inside surface of the rail foot of the tongue blades 15 and 16. The tubular part 2 is once again supported so as to be moveable within the fixed outer tube or housing 1 and once again, in each instance, there is a compression spring 33 between the stop 9 of the bolt-like moveable part and the rim 10 of the tube 2. In this embodiment, the bolt 3 incorporates an annular groove 38 that corresponds to the stepped-down area 12 for the locks of the preceding embodiments, into which, when the bolt-like parts 3 that are connected to each other are in the appropriate position, the lock elements 4 can move, so that the tubular part 2 can move within the outer tube 1. Corresponding to the peripheral groove 38, the outer tube 1 has on its inside circumference a peripheral groove 39 that corresponds to the stepped-down area 14 in the preceding embodiments. When the tongue blades are shifted from the starting position that is shown in FIG. 11*a* into the second end position shown in FIG. 11*d*, the stored up energy in the spring, as is shown in FIGS. 11*b* and 11*c*, is released during the displacement to the closing tongue blades, and imparted to the tongue rail 15 that is shown in FIGS. 11*a* to 11*d* on the right-hand side.

FIGS. 12*a* to 12*d* once again show the switching aid when the apparatuses to lock the end positions of moveable switch-points are used; in this, in contrast to the configuration shown in 11*a* to 11*d*, there is a connection between the bolt-like elements 3 and the rail foot of the tongue blade 15 or 16 through links 40, which are hinged at 41 or 42 to the rail foot or the particular bolt-like moveable element 3. This results in a pull-type and push-type switching aid, so that the connecting rod can be dispensed with. The switching movement is effected, as in the embodiment shown in FIGS. 11*a* to 11*d*, when, in addition, for an exact matching to the position of the particular tongue rails, the connecting element 43 of the link 40 can be screwed into a recess 44 in the end of the bolt-like element 3. In this embodiment, too, the energy stored in the springs 33 can be imparted to the closing tongue blades during displacement.

In the embodiments that are shown in FIG. 11 and FIG. 12, a separate actuator drive is used for the switching movement, this being known per se and not shown in greater detail.

In total, in the apparatus for locking the end positions of moveable switch-point parts, the result is that all the parts, namely the outer tube 1, the tubular moveable part 2, and the bolt-like moveable part 3, are machined, turned parts and thus are moveable co-axially relative to each other and in each other. In addition, the fixed outer tube can be easily sealed.

In addition, all of the lock elements or elements for the switching aide can be moved towards each other only in the longitudinal direction so that in total the overall structure is simple and installation relative to the rail can be effected on a tie between the moveable tongue blades.

As an example, eight locks are used for a switch-point, in particular for a high-speed switch-point with a large radius of curvature.

I claim:

1. A railway switch-point lock for locking end positions of movable switch-point parts comprising:

a fixed outer tube within which is housed in sealed relationship an inner tube surrounding a bolt, said tubes and the bolt having a common longitudinal axis said bolt having a length greater than each of said tubes;

locking means radially directed towards an inner surface of said outer tube for preventing longitudinal movement between said inner and outer tubes during an initial distance of movement of said bolt relative to said tubes; and means for disabling said locking means when said bolt moves beyond said initial distance whereby the bolt and the inner tube move relative to the outer tube.

2. A railway switch-point lock as set forth in claim 1, wherein said locking means is disposed within openings in said inner tube and extends within a section of the outer tube having an increased inside diameter when said locking means is preventing longitudinal movement between the inner and outer tubes.

3. A railway switch-point lock as set forth in claim 1 or 2, wherein one end of each of the inner tube and the bolt is provided with a cooperative engaging portion whereby when said bolt moves beyond said initial distance, said portions cooperate to cause both the inner tube and the bolt to move together relative to the outer tube.

4. A railway switch-point lock as set forth in claim 1 or 2, wherein said means for disabling the locking means includes a portion of the bolt having a reduced diameter into which the locking means moves when the bolt completes the initial distance of movement.

5. A railway switch-point lock as set forth in claim 4, wherein one end of each of the inner tube and the bolt is provided with a cooperative mating portion whereby when said bolt moves beyond said initial distance, said portions cooperate to cause both the inner tube and the bolt to move together relative to the outer tube.

6. A railway switch-point lock as set forth in claim 4, wherein said locking means comprises balls or rollers, and wherein the difference between the reduced diameter of the bolt and an outer diameter of said inner tube is greater than the diameter of the locking means.

7. A railway switch-point lock as set forth in claim 6, wherein the inner tube has a wall thickness greater than half the diameter of the locking means.

8. A railway switch-point lock as set forth in claim 5, further comprising spring means interposed between the cooperating portions of the inner tube and the bolt.

9. A railway switch-point lock as set forth in claim 1 or 2, wherein the inner surface of said outer tube is provided with at least two spaced annular grooves for receiving the locking means.

10. A railway switch-point lock as set forth in claim 1 or 2, wherein sad bolt is adapted to be longitudinally displaced by an actuator drive joined to the bolt.

11. A railway switch-point lock as set forth in claim 10, wherein the actuator drive is positioned within the outer tube.

* * * * *